US008215783B2

(12) United States Patent
Lai

(10) Patent No.: US 8,215,783 B2
(45) Date of Patent: Jul. 10, 2012

(54) LED LAMP

(75) Inventor: Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 262 days.

(21) Appl. No.: 12/768,742

(22) Filed: Apr. 28, 2010

(65) Prior Publication Data

US 2011/0157894 A1 Jun. 30, 2011

(51) Int. Cl.
*F21V 33/00* (2006.01)

(52) U.S. Cl. ..... 362/96; 362/249.02; 362/294; 362/373; 362/431; 362/800

(58) Field of Classification Search ..... 362/96, 362/249.02, 294, 373, 431, 800
See application file for complete search history.

(56) References Cited

U.S. PATENT DOCUMENTS

2009/0244901 A1 10/2009 Hu et al.

FOREIGN PATENT DOCUMENTS

CN 101435544 A 5/2009
CN 101545602 A 9/2009

*Primary Examiner* — Jason Moon Han
(74) *Attorney, Agent, or Firm* — Altis Law Group, Inc.

(57) ABSTRACT

An LED lamp includes a lamp support and a light-source module mounted on the lamp support. The lamp support includes a main post and a branch post extending from the main post. The main post is tubular and defines a first airflow tunnel inside the main post. The branch post is tubular and defines a second airflow tunnel inside the branch post, and the second airflow tunnel is directly communicated with the outer environment. The first and second airflow tunnels are communicated with each other. The light-source module is located at a position through which an airflow from the first and second airflow tunnels of the main post and the branch post flows.

19 Claims, 4 Drawing Sheets

LED LAMP

BACKGROUND

1. Technical Field

The disclosure relates to LED (light emitting diode) lamps for illumination purpose and, more particularly, relates to an improved LED lamp having a good heat dissipation.

2. Description of Related Art

An LED lamp is a type of solid-state lighting that utilizes LEDs as a source of illumination. An LED is a device for transferring electricity to light by using a theory that, if a current is made to flow in a forward direction through a junction region comprising two different semiconductors, electrons and holes are coupled at the junction region to generate a light beam. The LED has an advantage that it is resistant to shock, and has an almost eternal lifetime under a specific condition; thus, the LED lamp is intended to be a cost-effective yet high quality replacement for incandescent and fluorescent lamps.

An LED lamp generally requires a plurality of LEDs mostly driven at the same time, which results in a rapid rise in operating temperature of the LEDs. However, since the lamps lack effective heat dissipation mechanisms, continuous operation of the LED lamps can cause an overheat of the LEDs, resulting in a flickering or even a malfunction of the LEDs.

What is needed, therefore, is an improved LED lamp which can overcome the above problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
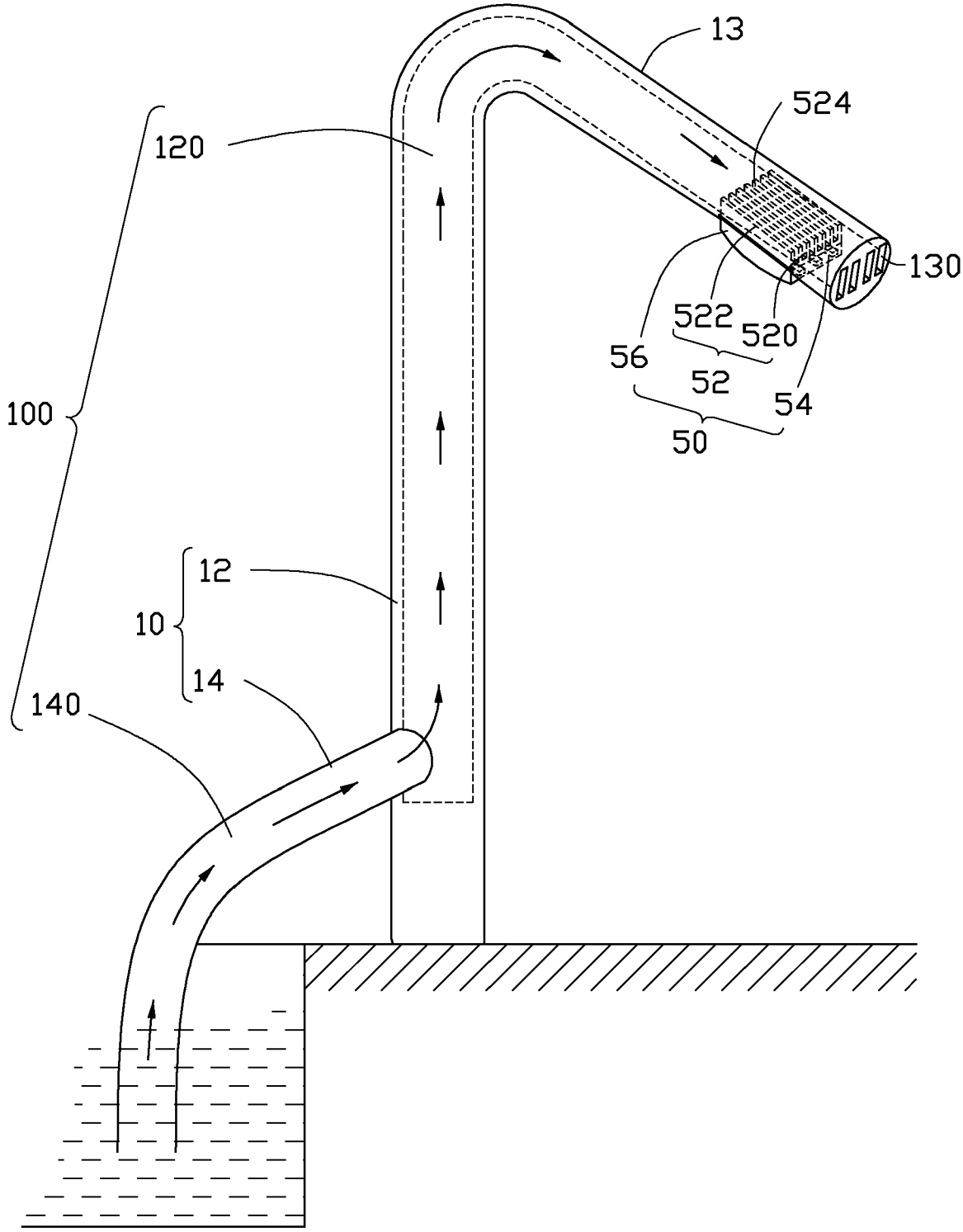
FIG. 1 shows an LED lamp in accordance with a first embodiment of the disclosure.

Referring to FIG. 1, a light emitting diode (LED) lamp in accordance with a first embodiment of the disclosure is illustrated. The LED lamp comprises a lamp support 10 and a light-source module 50 mounted on the lamp support 10.

The lamp support 10 comprises a main post 12 and a branch post 14 extending downwardly from the main post 12. The main post 12 is tubular and defines a first airflow tunnel 120 at a center thereof. A bottom portion of the main post 12 is firmly installed on ground. The main post 12 is perpendicular to the ground. A top portion 13 of the main post 12 is bended downwardly and faces the ground. A plurality of through holes 130 are defined at a distal end of the top portion 13 of the main post 12. The first airflow tunnel 120 is communicated with an outer environment through the through holes 130.

The branch post 14 is tubular and defines a second airflow tunnel 140 at a center thereof. The branch post 14 defines two openings (not labeled) at two opposite ends thereof, respectively. An end of the branch post 14 connects with the main post 12 and interconnects the first and second airflow tunnels 120, 140, whereby the first and second airflow tunnels 120, 140 are communicated with each other. A distal end of the branch post 14 is open and extended into a natural environment, such as air, sea, river, or lake. The first airflow tunnel 120 is communicated with the second airflow tunnel 140 to form an airflow passage 100 inside the lamp support 10, for natural air flowing through the LED lamp.

The light-source module 50 comprises a heat sink 52 and an LED module 54 thermally attached on the heat sink 52. The heat sink 52 is integrally made of a metal with good heat conductivity such as aluminum, copper or an alloy thereof. The heat sink 52 is inserted into the top portion 13 of the main post 12 of the lamp support 10 and located in the first airflow tunnel 120. The heat sink 52 comprises a base 520 and a plurality of fins 522 extending outwardly form a face of the base 520. The fins 522 are spaced form and parallel to each other. An airflow channel 524 is formed between every two adjacent fins 522. Each airflow channel 524 extends along a direction as the first airflow tunnel 120 extends.

The LED module 54 comprises a plurality of LEDs (not labeled) mounted on the base 522 of the heat sink 52. The LEDs are placed opposite to the fins 524 and face downwardly towards the ground. The LEDs are evenly arranged on the base 522. An envelope 56 is further provided to the light-source module 50. The envelope 56 is hermetically mounted on the base 522 and cooperates with the base 522 to enclose the LED module 54 therein for increasing the sealing performance of the LEDs of the LED lamp, thereby to protect the LEDs from contamination and moisture. Furthermore, the envelope 56 can function to modulate the light generated by the LEDs to have a desired pattern. The envelope protrudes downwardly out of the top portion 13.

In use, the LED lamp can be installed at an embankment adjacent to a natural water source, such as sea, river or lake. When the LEDs are activated, heat generated by the LEDs are transferred to the heat sink 52 on which the LED module 54 is mounted. The distal end of the branch post 14 of the lamp support 10 is inserted into the water source. Wave of the sea, river or lake would make air in the airflow passage 100 flow upwardly, whereby an airflow can be generated to flow in the airflow passage 100 and to the environment through the through holes 130, thereby helping dissipation of heat from the heat sink 52 to the environment. Alternatively, the distal end of the branch post 14 can be disposed in air. In this state, two opposite openings of the airflow passage 100 are both communicated with the air. When the air flows through the airflow passage 100, it also helps to dissipate heat from the heat sink 52.

Figure 2:
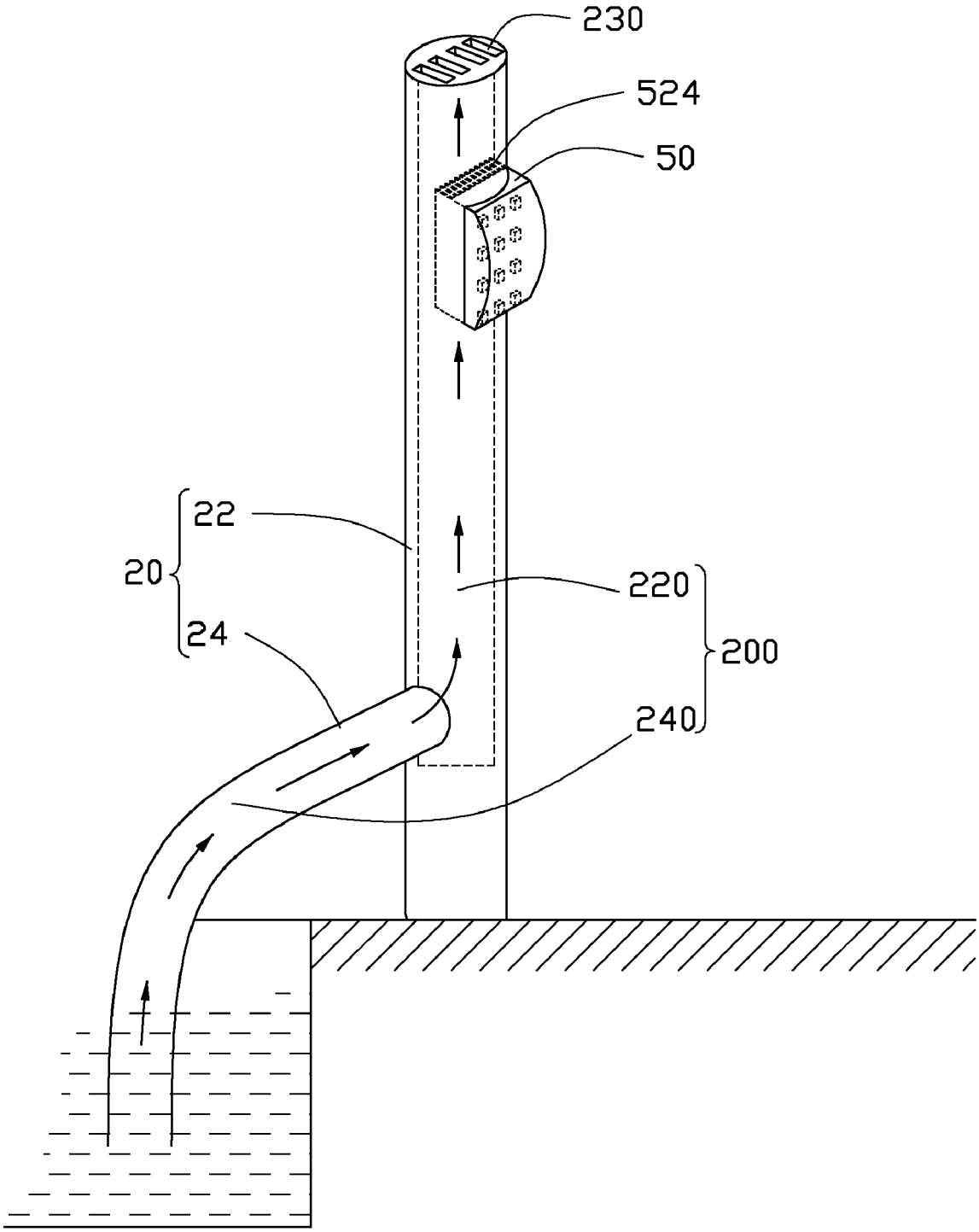
FIG. 2 shows an LED lamp in accordance with a second embodiment of the disclosure.

Referring to FIG. 2, an LED lamp of a second embodiment of this disclosure is illustrated. The LED lamp comprises a lamp support 20 and a light-source module 50 mounted on the lamp support 20. The lamp support 20 comprises a main post 22 and a branch post 24 extending downwardly from the main post 22. The main post 22 is tubular and defines a first airflow tunnel 220 at a center thereof. The main post 22 is straight and installed on the ground upwardly. A plurality of through holes 230 are defined at a top end of the main post 22 and communicated with the first airflow tunnel 220. The branch post 24 is tubular and defines a second airflow tunnel 240 at a center thereof. An end of the branch post 24 is connected with the main post 22, and interconnects the first and second airflow tunnels 220, 240, whereby the first and second airflow tunnels 220, 240 are communicated with each other. The first airflow tunnel 220 is combined with the second airflow tunnel 240 to form an airflow passage 200 inside the lamp support 20, for natural air flowing therethrough. The light-source module 50 is mounted on a lateral side of the lamp support 20, near the top end of the lamp support 20. It is understood that the LED lamps of the first and second embodiments of this disclosure work on the same principle.

Figure 3:
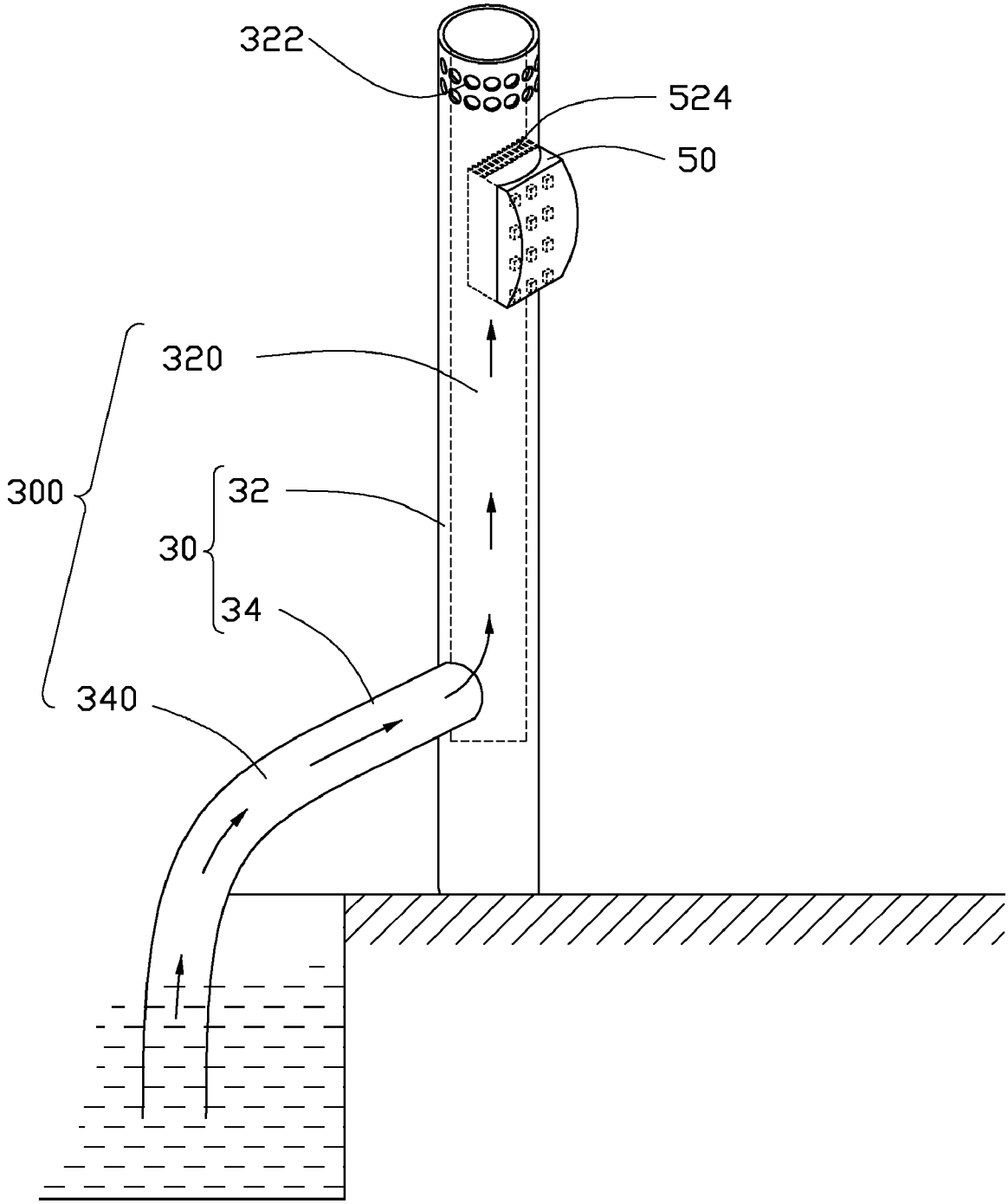
FIG. 3 shows an LED lamp in accordance with a third embodiment of the disclosure.

Referring to FIG. 3, an LED lamp of a third embodiment of this disclosure is illustrated. The LED lamp comprises a lamp support 30 and a light-source module 50 mounted on the lamp support 30. The lamp support 30 comprises a main post 32 and a branch post 34 extending downwardly from the main post 32. The main post 32 is tubular and defines a first airflow tunnel 320 at a center thereof. The main post 32 is straight and installed on the ground upwardly. A top end of the main post 32 is sealed. A plurality of through holes 322 are defined at a periphery of a top portion of the main post 32 and communicated with the first airflow tunnel 320. The branch post 34 is tubular and defines a second airflow tunnel 340 at a center thereof. An end of the branch post 34 is connected with the main post 32, and the first and second airflow tunnels 320, 340 are communicated with each other. The first airflow tunnel 320 is combined with the second airflow tunnel 340 to form an airflow passage 300 inside the lamp support 30, for natural air flowing therethrough. The light-source module 50 is mounted on a lateral side of the lamp support 30, near the top end of the lamp support 30. It is understood that the LED lamps of the first and third embodiments of this disclosure work on the same principle. The air flows upwardly to the top end of the main post 32, from there the air flows laterally through the through holes 322 to the environment.

Figure 4:
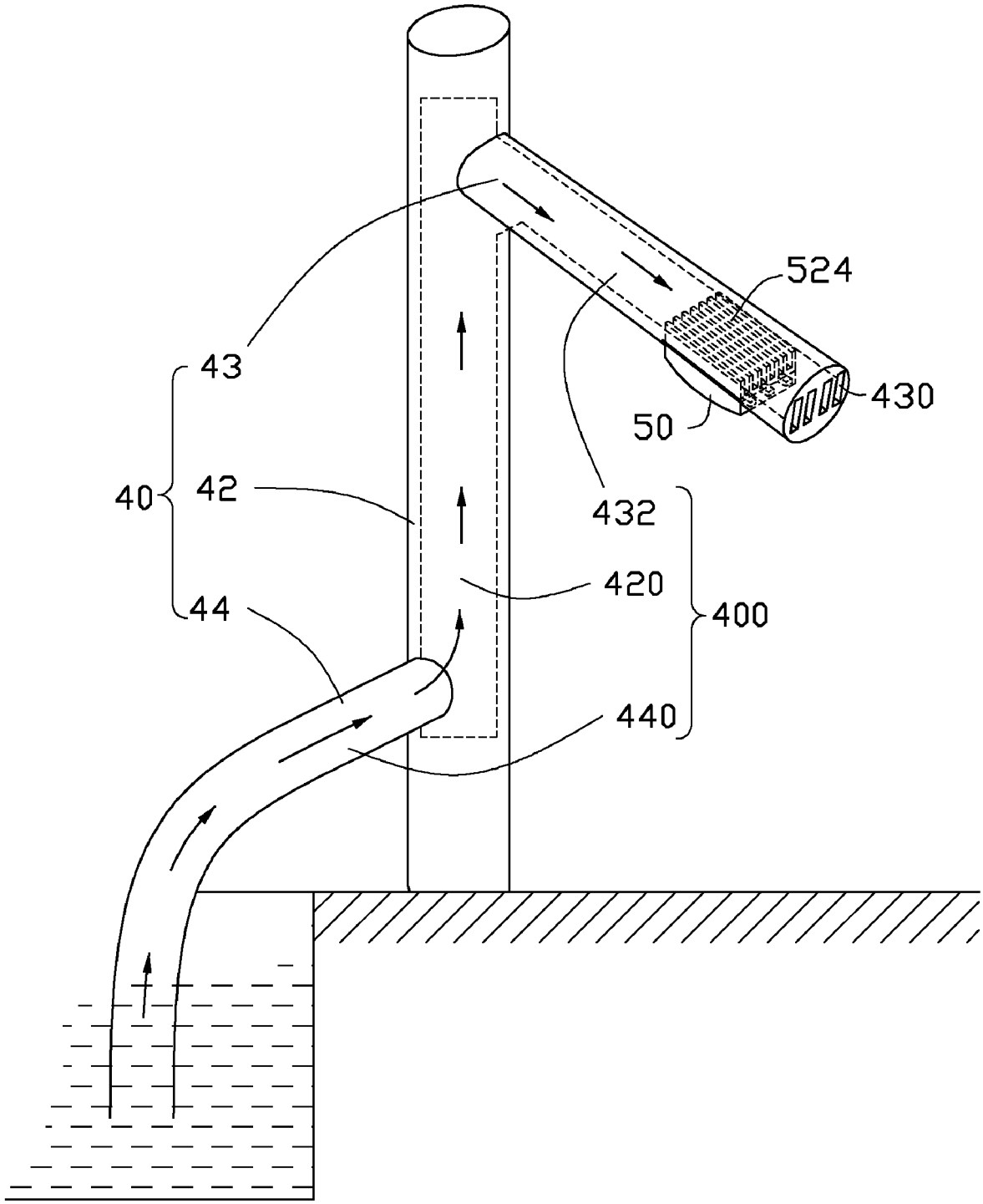
FIG. 4 shows an LED lamp in accordance with a forth embodiment of the disclosure.

Referring to FIG. 4, an LED lamp of a forth embodiment of this disclosure is illustrated. The LED lamp comprises a lamp support 40 and a light-source module 50 mounted on the lamp support 40. The lamp support 40 comprises a main post 42, a mounting post 43 and a branch post 44 respectively extending from the main post 42. The main post 42 is tubular and defines a first airflow tunnel 420 at a center thereof. The main post 42 is straight and installed on the ground upwardly. A top end of the main post 42 is sealed. The branch post 44 is tubular and defines a second airflow tunnel 440 at a center thereof. An end of the branch post 44 is connected with the main post 42 at a bottom portion of the main post 42, and the first and second airflow tunnels 420, 440 are communicated with each other. The mounting post 43 is tubular and defines a third airflow tunnel 432 at a center thereof. An end of the mounting post 43 is connected with the main post 42 at a top portion of the main post 42, and the first and third airflow tunnels 420, 432 are communicated with each other. A plurality of through holes 430 are defined at a distal end of the mounting post 43 and communicated with the third airflow tunnel 432. The first airflow tunnel 420 is combined with the second and third airflow tunnels 440, 432 to form an airflow passage 400 inside the lamp support 40, for natural air flowing therethrough. The light-source module 50 is mounted on the mounting post 43 of the lamp support 40 and faces towards the ground. It is understood that the LED lamp of the forth embodiment works on the same principle as the LED lamps of the previous embodiments.

It is to be understood, however, that even though numerous characteristics and advantages of the disclosure have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp comprising:

a lamp support mounted into a ground surface comprising a main post and a branch post extending from the main post, the main post being tubular and defining a first airflow tunnel inside the main post, the branch post being tubular and defining a second airflow tunnel inside the branch post, the second airflow tunnel directly communicated with an outer environment, the first and second airflow tunnels communicated with each other; and a light-source module being mounted on the lamp support and located at a position through which an airflow from the first airflow tunnel and then the second airflow tunnel flows, wherein an end of the branch post is inserted into a natural water source.

2. The LED lamp as described in claim 1, wherein the light-source module comprises a heat sink and a plurality of LEDs mounted on the heat sink.

3. The LED lamp as described in claim 2, wherein the first airflow tunnel of the main post is a tunnel directly communicated with the outer environment.

4. The LED lamp as described in claim 3, wherein the heat sink is received in the first airflow tunnel of the main post.

5. The LED lamp as described in claim 2, wherein the heat sink comprises a base and a plurality of fins extending outwardly from the base, the fins being spaced from each other, an airflow channel being defined between every two adjacent fins.

6. The LED lamp as described in claim 5, wherein each airflow channel extends along a direction as the first airflow tunnel extends.

7. The LED lamp as described in claim 1, wherein the light-source module further comprises an envelope mounted on the base, and the envelope cooperates with the base to enclose the LEDs therein.

8. The LED lamp as described in claim 1, wherein the main post defines a plurality of through holes through which the first airflow tunnel is communicated with the outer environment.

9. The LED lamp as described in claim 8, wherein the through holes are defined at a distal end of the main post.

10. The LED lamp as described in claim 8, wherein the through holes are defined at a periphery of the main post.

11. The LED lamp as described in claim 1, wherein the end of the branch post is connected with the main post at a bottom portion of the main post.

12. The LED lamp as described in claim 11, wherein an opposite end of the branch post is open, whereby the second airflow tunnel is communicated with the outer environment.

13. The LED lamp as described in claim 1, wherein the light-source module is mounted on the main post of the lamp support.

14. The LED lamp as described in claim 1, wherein the main post is upwardly installed on an embankment near a natural water source.

15. The LED lamp as described in claim 1, wherein the branch post is inserted into a natural liquid environment capable of producing wave.

16. The LED lamp as described in claim 1, wherein the lamp support further comprises a mounting post extending outwardly from the main post, and the mounting post is tubular and defines a third airflow tunnel communicating the first airflow tunnel with the outer environment.

17. The LED lamp as described in claim 16, wherein the light-source module is mounted on the mounting post and has a portion thereof received in the third airflow tunnel.

18. A lamp comprising:

a light-source module;

a first post mounting the light-source module thereon, the first post defining an airflow tunnel therein for guiding airflow to the light-source module, wherein the first post is mounted into a ground surface comprising;

a second post engaging with the first post, the second post defining another airflow tunnel communicating with and providing airflow to the airflow tunnel of the first post, wherein an end of the second post is inserted into a natural water source.

19. The lamp as described in claim 18, wherein the light-source module comprises an LED for emitting light and a heat sink thermally contacting the LED.

* * * * *